US010413008B2

(12) United States Patent
Ji

(10) Patent No.: US 10,413,008 B2
(45) **Date of Patent: *Sep. 17, 2019**

(54) PROCESS FOR PRODUCING AIR KNIT HEADWEAR

(71) Applicant: Jun Ji, Rugao (CN)

(72) Inventor: Jun Ji, Rugao (CN)

( * ) Notice: Subject to any disclaimer, the term of this patent is extended or adjusted under 35 U.S.C. 154(b) by 216 days.

This patent is subject to a terminal disclaimer.

(21) Appl. No.: 15/581,231

(22) Filed: Apr. 28, 2017

(65) Prior Publication Data

US 2018/0206572 A1 Jul. 26, 2018

(51) Int. Cl.

| | |
|---|---|
| ***A42B 1/04*** | (2006.01) |
| ***A42C 1/08*** | (2006.01) |
| ***D01H 13/30*** | (2006.01) |
| ***D04B 1/24*** | (2006.01) |
| ***A42C 1/00*** | (2006.01) |

(52) U.S. Cl.

CPC ..... *A42B 1/041* (2013.01); *A42C 1/00* (2013.01); *A42C 1/08* (2013.01); *D01H 13/306* (2013.01); *D01H 13/308* (2013.01); *D04B 1/24* (2013.01); *D10B 2501/042* (2013.01)

(58) Field of Classification Search

CPC ..... D06B 3/04; D06B 3/045; D06B 3/06; D06B 3/08; D06B 3/09; D01H 13/302; D01H 13/306; D01H 13/308; D04B 21/207; A42B 1/041; A42C 1/00; A42C 1/08

USPC ..... 252/8.84; 106/245; 2/200.1

See application file for complete search history.

(56) References Cited

U.S. PATENT DOCUMENTS

| | | | | | |
|---|---|---|---|---|---|
| 2,224,665 | A | * | 12/1940 | Bradshaw | D02H 3/00 242/166 |
| 2,272,588 | A | * | 2/1942 | Simison | C03C 25/20 118/125 |
| 2,375,971 | A | * | 5/1945 | Windschauer | D06B 3/04 118/405 |
| 2,776,435 | A | * | 1/1957 | Trimpert | A42B 1/02 2/175.5 |
| 2,939,201 | A | * | 6/1960 | Holland | D01D 5/253 264/177.13 |

(Continued)

FOREIGN PATENT DOCUMENTS

| | | |
|---|---|---|
| CN | 102162145 | 8/2011 |
| JP | 03234811 | 10/1991 |

OTHER PUBLICATIONS

Pending Non-Provisional U.S. Appl. No. 15/498,895, filed Apr. 27, 2017.

(Continued)

*Primary Examiner* — Clinton T Ostrup
*Assistant Examiner* — Patrick J. Lynch
(74) *Attorney, Agent, or Firm* — Hovey Williams LLP

(57) ABSTRACT

The present invention generally relates to the production of knitted caps that are lightweight and breathable. Generally, the manufacturing process for producing the knitted caps involves: (1) applying a continuous wax coating onto a polyester yarn; (2) twisting the yarn with one or more additional yarns to produce a twisted yarn; (3) knitting the twisted yarn into a knitted article; (4) sewing the knitted article into a headwear body; and (5) finishing the headwear body to form the headwear article. The resulting headwear articles can be in the form of caps that exhibit superior breathability and moisture wicking capabilities.

16 Claims, 2 Drawing Sheets

(56) References Cited

U.S. PATENT DOCUMENTS

| | | | | | |
|---|---|---|---|---|---|
| 3,224,225 | A * | 12/1965 | Blore | D04B 15/34 | 66/24 |
| 4,444,710 | A | 4/1984 | Most, Jr. | | |
| 4,583,987 | A * | 4/1986 | Kurz | D06P 1/0004 | 252/8.81 |
| 5,389,136 | A * | 2/1995 | Danner | C08L 91/08 | 106/271 |
| 5,584,076 | A * | 12/1996 | Armstrong | A42B 1/22 | 2/181.4 |
| 5,785,997 | A * | 7/1998 | Budenbender | D01D 5/0885 | 264/178 R |
| 6,395,394 | B1 * | 5/2002 | Willemsen | D06M 7/00 | 252/8.61 |
| 6,472,019 | B1 * | 10/2002 | Yamaguchi | D06M 13/262 | 427/354 |
| 7,018,425 | B1 * | 3/2006 | Callaway | C08J 11/06 | 252/8.83 |
| 2005/0262643 | A1 * | 12/2005 | Nogues Lopez | D06M 7/00 | 8/115.51 |
| 2011/0057143 | A1 * | 3/2011 | Yamakita | D06M 7/00 | 252/8.84 |
| 2017/0233901 | A1 * | 8/2017 | Ackroyd | D02G 3/04 | 57/244 |

OTHER PUBLICATIONS

Pending Non-Provisional U.S. Appl. No. 15/581,282, filed Apr. 28, 2017.
Machine Translation of CN102162145, Jiqiang et al. (Year: 2011).
Machine Translation of JPH03234811, Shimizu (Year: 1991).
Office Action from co-pending U.S. Appl. No. 15/498,895, dated Feb. 7, 2019.

* cited by examiner

PROCESS FOR PRODUCING AIR KNIT HEADWEAR

RELATED APPLICATIONS

This application claims the foreign priority benefit of Chinese Patent Application Serial No. 201710041540.8 filed on Jan. 23, 2017, the entire disclosure of which is incorporated herein by reference.

BACKGROUND

1. Field of the Invention

The present invention generally relates to knitting technology. More particularly, the present invention generally relates to processes for producing knitted headwear.

2. Description of the Related Art

Common knitted articles can include, for example, towels, underwear, sportswear, socks, hats, and various other articles. Such articles can exhibit desirable elasticity characteristics and be generally comfortable for people to wear.

A common knitted article includes knitted caps. Such caps can address a myriad of needs, such as providing warmth to the wearer in colder conditions. Generally, a common knitted cap is prepared by the following steps: (1) a yarn is coated with a paraffin wax; (2) the wax-treated yarn is then fed through a cross-weaving machine to form a cap sheet; (3) the cap sheets are sewn together to form the cap pieces; and (4) the cap pieces are stitched together using a stereotype plate shape. However, such conventional production processes comprise various disadvantages. For example, the use of a yarn coated with a paraffin wax can result in an easily-coiled yarn that is unstable and a fabric that exhibits inconsistent texture size, enhanced surface roughness, and greater pilling. Furthermore, the conventional process described above can produce caps that are relatively thick and airtight, thereby decreasing air flow through the fabric. Additionally, conventional knitted caps can be difficult to clean based on the thickened and airtight fabrics used to produce them.

Accordingly, there is a need for a process that produces a knitted cap that is lightweight, breathable, and exhibits other properties desired by the wearer.

SUMMARY

One or more embodiments of the present invention are directed to a process for the production of a headwear article. The process involves: (a) applying a wax onto a yarn to form a treated yarn, wherein the wax comprises a paraffin wax, a silicone oil, a white oil, and a rapeseed oil, wherein the yarn comprises at least one polyester filament; (b) twisting the treated yarn with at least one additional yarn to form a twisted yarn; (c) knitting the twisted yarn with a jacquard machine to thereby form a knitted article; (d) sewing the knitted article into a headwear body; and (e) finishing the headwear body to form the headwear article, wherein the finishing comprises ironing at least a portion of the headwear body.

One or more embodiments of the present invention are directed to a process for the production of a headwear article. The process involves: (a) applying a wax onto a yarn to form a treated yarn, wherein the yarn comprises at least two polyester filaments, wherein the wax comprises: (i) a paraffin wax, a silicone oil, a white oil, and a rapeseed oil, (ii) a weight ratio of the paraffin wax to the silicone oil, the white oil, and/or the rapeseed oil of at least 2:1, (iii) a weight ratio of the silicone oil to the white oil or the rapeseed oil of at least 1:1, and (iv) a weight ratio of the white oil to the rapeseed oil of at least 1:1; (b) twisting the treated yarn with at least one additional yarn to form a twisted yarn; (c) knitting the twisted yarn to thereby form a knitted article; (d) sewing the knitted article into a headwear body; and (e) finishing the headwear body to form the headwear article, wherein the finishing comprises ironing at least a portion of the headwear body.

One or more embodiments of the present invention are directed to a knitted cap comprising a yarn containing one or more polyester filaments. The polyester filaments comprise a lobed-shape cross section comprising a plurality of lobes and a transverse aspect ratio of at least 1.5:1. Furthermore, the yarn is at least partially coated with a wax comprising (i) a paraffin wax, a silicone oil, a white oil, and a rapeseed oil, (ii) a weight ratio of the paraffin wax to the silicone oil, the white oil, and/or the rapeseed oil of at least 2:1, (iii) a weight ratio of the silicone oil to the white oil or the rapeseed oil of at least 1:1, and (iv) a weight ratio of the white oil to the rapeseed oil of at least 1:1.

BRIEF DESCRIPTION OF THE FIGURES

Embodiments of the present invention are described herein with reference to the following drawing figures, wherein.

DETAILED DESCRIPTION

Figure 1:
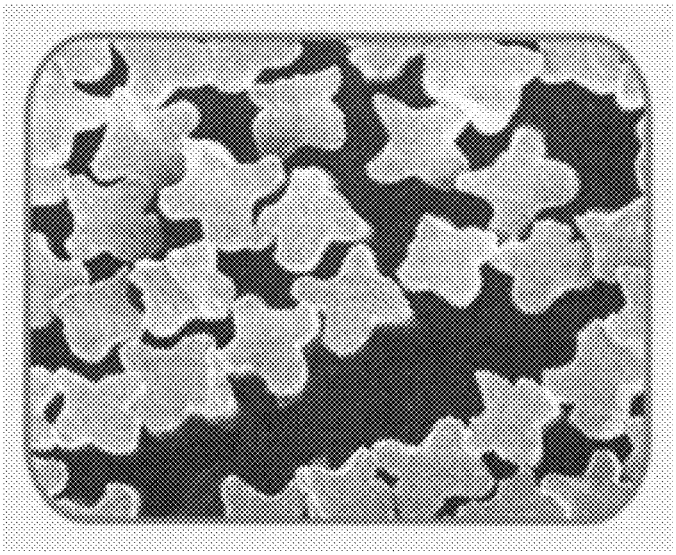
FIG. 1 depicts a cross-sectional view of the moisture-wicking polyester filaments.

The present invention generally relates to the production of knitted headwear articles that are lightweight and breathable. Generally, the manufacturing process for producing the knitted caps involves: (1) applying a continuous wax coating onto a polyester yarn; (2) twisting the yarn with one or more additional yarns to produce a twisted yarn; (3) knitting the twisted yarn into a knitted article; (4) sewing the knitted article into a headwear body; and (5) finishing the headwear body to form the headwear article. The resulting headwear articles can be in the form of caps that exhibit superior breathability and moisture-wicking capabilities.

Each of the aforementioned steps of the inventive process for producing the knitted headwear articles are discussed in detail below.

The production process of the present invention begins by applying a wax coating on at least a portion of an initial yarn. The wax can be capable of protecting the surface of the yarn and enhancing the lubricity and smoothness of the yarn. In various embodiments, the wax can be coated onto the yarn using conventional machinery and techniques known in the art, such as a roll dipper. Furthermore, in one or more embodiments, multiple coats of the wax can be applied onto the yarn in order to ensure that the wax is continuously and uniformly coated on the yarn. For instance, the wax application step can involve applying at least 2, 3, or 4 coats of the wax onto the yarn.

The choice of yarn used in the process of the present invention is important and can directly influence many properties in the resulting headwear articles. Unlike other headwear production processes, the production process of the present invention can use a thinner polyester yarn, which can result in a headwear article with a more consistent texture size.

In various embodiments, the initial yarn used in the wax application step comprises a yarn that contains a single polyester filament or a plurality of polyester filaments. In certain embodiments, the initial yarn comprises, consists essentially of, or consists of at least 2, 3, or 4 polyester filaments. Additionally or alternatively, in various embodiments, the yarn can comprise an average denier in the range of 25 to 100 denier, 50 to 80 denier, or preferably about 75 denier. In one or more embodiments, the yarn can comprise a dyed polyester yarn.

In various embodiments, the polyester filaments may be produced from polyethylene terephthalate or derivatives thereof.

In one or more embodiments, the polyester filaments forming the yarns can comprise longitudinal grooves that can function as capillaries, which facilitate the moisture wicking capabilities of the filament. For example, the polyester filaments can comprise a non-round cross-sectional shape, such as, for example, a lobed shape. In such embodiments, the polyester filaments can be non-round filaments having a lobed-shaped cross section, a clover leaf-shaped cross section, a triangular-shaped cross section, an X-shaped cross-section, or a flat-shaped cross section.

In one or more embodiments, the polyester filaments have a lobed-shape cross section. In various embodiments, the filaments have a cross-sectional lobed-shape comprising at least 1, 2, 3, 4, 5, 6, 7, or 8 lobes. In certain embodiments, the filaments have a lobed-shape cross section with 4 lobes. As shown in FIG. 1, the polyester filaments used to form the yarns of the present invention can comprise a lobed-shape cross section with 4 lobes.

In various embodiments, the polyester filaments used to form the yarns can have an average cross-sectional surface area of at least 50, 100, 200, 300, 400, or 500 $\mu m^2$ and/or not more than 10,000, 5,000, or 2,000 $\mu m^2$.

Figure 2:
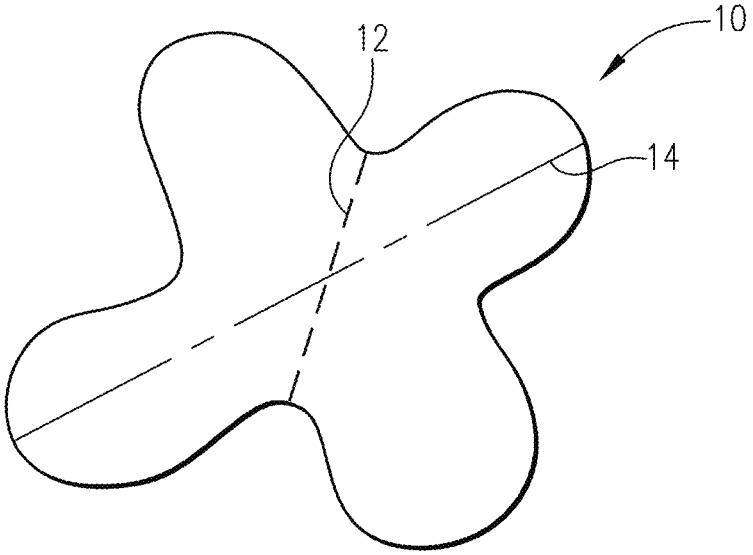
FIG. 2 depicts a cross-sectional view of a single moisture-wicking polyester filament.

In various embodiments, the polyester filaments may have a minimum transverse width of less than about 1,000, 750, 500, 400, 300, 200, 100, or 50 μm. Additionally or alternatively, the polyester filaments may have a maximum transverse width of less than about 10,000, 5,000, 2,000 μm, but greater than about 1,000, 750, 500, 400, 300, 200, 100, or 50 μm. As used herein, the "minimum transverse width" denotes the minimum cross-sectional width of a filament as measured perpendicular to the length of the filament. In addition, as used herein, the "maximum transverse width" denotes the maximum cross-sectional width of a filament as measured perpendicular to the length of the filament. FIG. 2 demonstrates how the minimum transverse width and maximum transverse width of the filaments may be measured. In particular, as shown in FIG. 2, the cross-section of the filament 10 comprises a minimum transverse width 12 and a maximum transverse width 14.

Typically, the minimum transverse width and the maximum transverse width should be nearly identical for polyester filaments having a round-shaped cross-section. However, these dimensions may greatly vary if filaments containing different cross-sectional shapes are used (e.g., lobed-shape). In one or more embodiments, the polyester filaments can have a transverse aspect ratio of at least 1:1, 1.25:1, 1.5:1, 1.75:1, 2:1, 3:1, 4:1, 5:1, or 10:1. Additionally or alternatively, the polyester filaments can have a transverse aspect ratio of less than 10,000:1, 5,000:1, 1,000:1, 500:1, 100:1, 50:1, 20:1, 10:1, 5:1, 4:1, 3:1, 2.5:1, 2:1, 1.75:1, or 1.5:1. As used herein, "transverse aspect ratio" denotes the ratio of a filament's maximum transverse width to the filament's minimum transverse width.

As noted above, the polyester filaments that form the initial yarns can improve the capillary effects of the fabrics produced from the yarns. In particular, the polyester filaments can comprise grooves along their longitudinal surface that facilitate this capillary function. More specifically, the longitudinal grooves can facilitate the movement of moisture within the fabric, thereby allowing the moisture to be moved from the wearer's skin to the surface of the fabric, where the moisture can begin to evaporate.

Furthermore, the type of wax utilized in the process of the present application can influence and affect various properties of the resulting headwear articles. In various embodiments, the wax comprises a paraffin wax, a silicone oil, a white oil, a rapeseed oil, or a mixture thereof. In certain embodiments, the wax comprises a paraffin wax, a silicone oil, a white oil, and a rapeseed oil. Additionally or alternatively, the wax can be in the form of a solid during the wax application step.

In one or more embodiments, the wax comprises at least 25, 50, 75, 90, or 93 weight percent and/or less than 99, 98, or 95 weight percent of at least one paraffin wax. In certain embodiments, the wax comprises about 93 weight percent of at least one paraffin wax.

In one or more embodiments, the wax comprises at least 0.5, 1, 2, or 4 weight percent and/or less than 99, 90, 75, 50, 25, or 10 weight percent of at least one silicone oil. In certain embodiments, the wax comprises about 4 weight percent of at least one silicone oil.

In one or more embodiments, the wax comprises at least 0.5, 1, 2, or 3 weight percent and/or less than 99, 90, 75, 50, 25, or 10 weight percent of at least one white oil. In certain embodiments, the wax comprises about 2 weight percent of a white oil. As used herein, "white oil" may be used interchangeably with mineral oil.

In one or more embodiments, the wax comprises at least 0.1, 0.5, or 1 weight percent and/or less than 99, 90, 75, 50, 25, 10, or 5 weight percent of a rapeseed oil. In certain embodiments, the wax comprises about 1 weight percent of rapeseed oil.

In certain embodiments, the wax comprises a weight ratio of paraffin wax to silicone oil, white oil, and/or rapeseed oil of at least 1:1, 2:1, 3:1, 4:1, 5:1, 6:1, 7:1, 8:1, 9:1, or 10:1 and/or less than 100:1, 75:1, or 50:1.

In certain embodiments, the wax comprises a weight ratio of silicone oil to rapeseed oil and/or white oil of at least 1:1, 2:1, 3:1, or 4:1.

In certain embodiments, the wax comprises a weight ratio of white oil to rapeseed oil of at least 0.5:1, 1:1, or 2:1.

After the wax application step, the wax-treated yarn is subjected to a twisting step to form a twisted yarn. During the twisting step, the wax-treated yarn may be twisted by itself or with one or more additional yarns. In various embodiments, the twisting step involves twisting the wax-treated yarn with at least 1, 2, 3, or 4 additional yarns. Additionally or alternatively, in various embodiments, the twisting step involves twisting the wax-treated yarn with less than 100, 50, 25, 10, or 4 additional yarns. In certain embodiments, the twisted yarns can comprise 2 to 4 yarns overall. In such embodiments, these additional yarns can comprise or consist of the wax-treated yarns described above. Thus, in such embodiments, the twisted yarn would comprise a plurality of the wax-treated yarns. Alternatively, the additional yarns can comprise yarns that are different from the wax-treated polyester yarns described above. For instance, the additional yarns can comprise wool yarns, cotton yarns, or other types of polyester yarns.

In various embodiments, the twisted yarn can have a twists per inch ("TPI") of at least 50, 75, 100, or 120 and/or less than 300, 250, 200, 175, or 140. In certain embodiments, the twisted yarn comprises a TPI in the range of 120 to 140.

The twisting step can be carried out using any conventional twisting machine known in the art.

In various embodiments, the twisted yarn may have a Z-twist or an S-twist.

After the twisting step, the twisted yarn can then be subjected to a knitting step to form a knitted article. As used herein, the terms "knitted article" and "woven article" can be used interchangeably.

In various embodiments, these knitted articles can comprise individual and separate pieces of a headwear article, such as a cap. In one or more embodiments, the knitting step can produce a knitted article entirely from the twisted yarn of the present invention. Alternatively, the knitting step can combine the twisted yarn of the present invention with other types of yarns, such as cotton yarns, wool yarns, or other types of polyester yarns. In one or more embodiments, the knitting step can involve a flat weaving process.

Furthermore, in various embodiments, the twisted yarns used in the knitting step can be dyed different colors. Thus, the resulting knitted article can comprise 2 or more colors. In such embodiments, the woven article can be a multi-colored article. Consequently, this can allow one to modify the resulting knitted articles accordingly to enhance the aesthetic properties of the knitted articles.

In certain embodiments, this knitting step can be carried out with a 12 gauge or a 14 gauge jacquard machine.

In various embodiments, the knitted article can comprise a fabric, such as an air layer fabric or a sesame point fabric. In one or more embodiments, the woven articles are in the form of fabrics and may exhibit a vertical wicking height of at least 75, 80, 85, 90, 95, 100, 105, or 110 mm/10 minutes as measured according to AATCC-79. Additionally or alternatively, the woven fabrics produced from the inventive polyester yarns may exhibit a water diffusion area of at least 1,500, 1,600, 1,700, or 1,800 $mm^2$/30 seconds.

After the knitting step, the knitted articles can be sewn together to form a headwear body. In various embodiments, the sewing step can involve sewing the knitted articles, such as the fabric forming a cap body, together to form the headwear body. This sewing step can be carried out using any conventional sewing machine known in the art and is not limited to a particular type of sewing machine. Generally, the sewing step requires that the knitted articles be sewn together using straight stitches such as, for example, running stitches, double-running stitches, satin stitches, and/or darning stitches.

During the sewing step, various jacquard fabrics having different patterns and colors from the knitting step can be combined to form the headwear body. Consequently, this selection and combination of a variety of jacquard fabrics allows one to design a headwear body that can be more aesthetically pleasing to consumers.

After the sewing step, the headwear body can then be subjected to a finishing step to produce the final headwear article. In various embodiments, this finishing step can involve subjecting the headwear body to ironing. In one or more embodiments, this ironing step can involve the use of styling plates that shape the headwear body into the headwear article. Furthermore, in various embodiments, it is generally preferable that the iron does not come into direct contact with the headwear body during the ironing step. In particular, it is preferred that a space of 1 to 2 cm be maintained between the iron and the headwear body during the ironing step.

In various embodiments, the ironing plates during the ironing step can be maintained at a temperature of at least 50, 75, or 90° C. and/or less than 180, 150, or 120° C. Additionally or alternatively, the steam pressure from the ironing plates can be maintained at a pressure of at least 2, 2.5, 3, or 3.4 kg/$cm^2$ and/or less than 8, 6, 5, or 4 kg/$cm^2$. In certain embodiments, the ironing plates can be maintained at a temperature in the range of 90 to 120° C. and the steam may be maintained at a pressure in the range of 3.4 to 4 kg/$cm^2$.

In one or more embodiments, the ironing step can occur for at least 20, 30, or 40 seconds and/or less than 80, 60, or 50 seconds. In certain embodiments, the ironing step can occur over a period of 40 to 50 seconds. After the ironing step, the ironed article can be subjected to drainage suction and then dry steam to make the final form of the resulting headwear article.

In various embodiments, the resulting headwear article can comprise a cap, a beanie, or any other type of hat produced from woven fabrics. The resulting headwear article can exhibit less pilling compared to other headwear articles produced using conventional processes. In addition, due to the inventive polyester yarns, the resulting headwear articles can exhibit superior moisture wicking, while still providing warmth and comfort to the wearer.

Furthermore, in various embodiments, the headwear articles of the present invention can exhibit superior air permeability. For instance, the headwear articles can exhibit an air permeability of at least 10, 12, 14, 15, 16, or 17 mm/s as measured by a Yg461-type air permeability tester according to GB/T 5453-1997 requirements.

This invention can be further illustrated by the following examples of embodiments thereof, although it will be understood that these examples are included merely for the purposes of illustration and are not intended to limit the scope of the invention unless otherwise specifically indicated.

EXAMPLES

Example 1

An exemplary knit cap was produced using the following process. First, a dyed polyester yarn was coated four times with a wax mixture in order to provide a uniform wax coating on the dyed polyester yarn. The dyed polyester yarn was formed from polyester filaments having a lobed-shape cross section with four lobes. The wax mixture comprised paraffin wax, silicone oil, white oil, and rapeseed oil at a weight ratio of 93:4:2:1, respectively. The wax-treated yarn was then reverse twisted with additional yarns to form a twisted yarn comprising 4 strands and a TPI of 140. After twisting, the twisted yarn was then weaved using a 14 gauge cross-weaving machine to form a fabric for cap bodies. During the weaving step, the specific color configuration of the resulting fabric was chosen. Next, the woven fabric was sewn together using straight stitches in order to form a knitted cap body. Finally, the knitted cap body was subjected to ironing with sizing plates heated to a temperature of about 120° C. and a steam pressure of about 3.4 kg/cm$^2$. During the ironing step, the iron did not come into contact with the cap body and the spacing between the iron plates and cap body was maintained at 1 cm. The ironing was carried out for 50 seconds, after which the cap body was subjected to drain suction and dry steam to thereby produce the finished cap.

Example 2

An exemplary knit cap was produced using the following process. First, a dyed polyester yarn was coated three times with a wax mixture in order to provide a uniform wax coating on the dyed polyester yarn. The dyed polyester yarn was formed from polyester filaments having a lobed-shape cross section with four lobes. The wax mixture comprised paraffin wax, silicone oil, white oil, and rapeseed oil at a weight ratio of 93:4:2:1, respectively. The wax-treated yarn was then reverse twisted with additional yarns to form a twisted yarn comprising 3 strands and a TPI of 130. After twisting, the twisted yarn was then weaved using a 12 gauge cross-weaving machine to form a fabric for cap bodies. During the weaving step, the specific color configuration of the resulting fabric was chosen. Next, the woven fabric was sewn together using straight stitches in order to form a knitted cap body. Finally, the knitted cap body was subjected to ironing with sizing plates heated to a temperature of about 90° C. and a steam pressure of about 4 kg/cm$^2$. During the ironing step, the iron did not come into contact with the cap body and the spacing between the iron plates and cap body was maintained at 2 cm. The ironing was carried out for 40 seconds, after which the cap body was subjected to drain suction and dry steam to thereby produce the finished cap.

Example 3

An exemplary knit cap was produced using the following process. First, a dyed polyester yarn was coated twice with a wax mixture in order to provide a uniform wax coating on the dyed polyester yarn. The dyed polyester yarn was formed from polyester filaments having a lobed-shape cross section with four lobes. The wax mixture comprised paraffin wax, silicone oil, white oil, and rapeseed oil at a weight ratio of 93:4:2:1, respectively. The wax-treated yarn was then reverse twisted with additional yarns to form a twisted yarn comprising 2 strands and a TPI of 120. After twisting, the twisted yarn was then weaved using a 12 gauge cross-weaving machine to form a fabric for cap bodies. During the weaving step, the specific color configuration of the resulting fabric was chosen. Next, the woven fabric was sewn together using straight stitches in order to form a knitted cap body. Finally, the knitted cap body was subjected to ironing with sizing plates heated to a temperature of about 105° C. and a steam pressure of about 3.7 kg/cm$^2$. During the ironing step, the iron did not come into contact with the cap body and the spacing between the iron plates and cap body was maintained at 1.5 cm. The ironing was carried out for 45 seconds, after which the cap body was subjected to drain suction and dry steam to thereby produce the finished cap.

Example 4

The caps produced in Examples 1-3 were compared to an acrylic cap produced with acrylic yarns using a conventional production process. All four caps were evaluated for pilling, surface roughness, and air permeability with a Yg461-type air permeability tester according to GB/T 5453-1997 requirements at a pressure drop of 200 Pa. The results of these tests are provided in Table 1, below.

| | Example 1 | Example 2 | Example 3 | Conventional Acrylic |
|---|---|---|---|---|
| Pilling phenomenon | No Pilling | No Pilling | No Pilling | Pilling |
| Surface roughness | 3 mm | 4 mm | 3 mm | 8 mm |
| Permeability | 17.6 mm/s | 17.8 mm/s | 18.2 mm/s | 9.8 mm/s |

As shown above, the caps produced from the inventive process provided a smoother cap surface that does not easily pill. Furthermore, the inventive caps provided greater breathability as indicated by their higher permeability values.

Example 5

Woven fabrics were produced from conventional nylon filaments, conventional round PET filaments, conventional cotton filaments, and the inventive polyester yarns described above. In particular, the inventive polyester yarns were produced from polyester filaments having a lobed-shape cross section. The moisture absorption and wicking properties of the fabrics were tested and compared.

Figure 3:
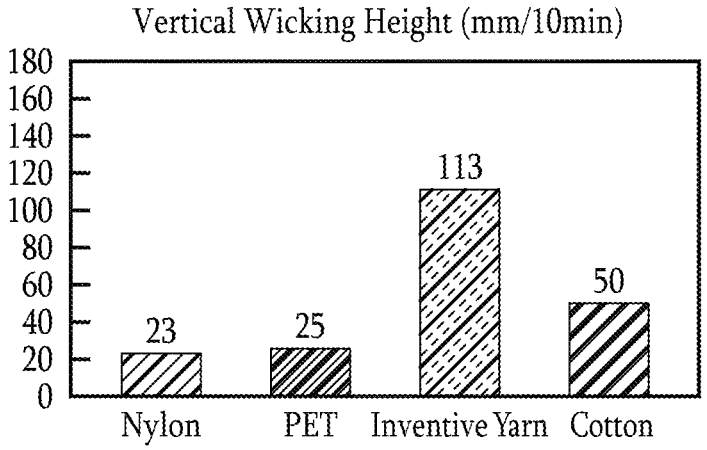
FIG. 3 is a bar graph depicting the Vertical Wicking Heights of various tested fabrics produced from nylon fibers, conventional polyethylene terephthalate (PET) fibers, cotton fibers, and the inventive polyester filaments.

The vertical wicking height (mm/10 minutes) was measured according to AATCC-79 for each of the produced fabrics. The test method for measuring the vertical wicking height comprised cutting the test fabrics into sample pieces having a size of 20 cm by 2.5 cm and submerging a designated portion of the sample fabric in a tank holding water. The tank was installed on a horizontal bar and the temperature of the water in the tank was maintained at 18 to 22° C. The samples were removed from the tank after 10 and 30 minutes in order to measure the rise of water in the portions of the fabric that were not submerged in the water. Consequently, this allowed one to observe the capillary effects of the filaments making up the fabrics. The rise of the water was measured from the designated submerge line to the top vertical height that the water reached in the fabric. These measurements were taken after 10 and 30 minutes. A measurement was repeated five times and the average value was calculated. As shown in FIG. 3, the fabric produced from the inventive polyester filament exhibited a significant higher wicking height after 10 minutes (113 mm/10 minutes) compared to fabrics produced from conventional nylon, PET, and cotton yarns.

Figure 4:
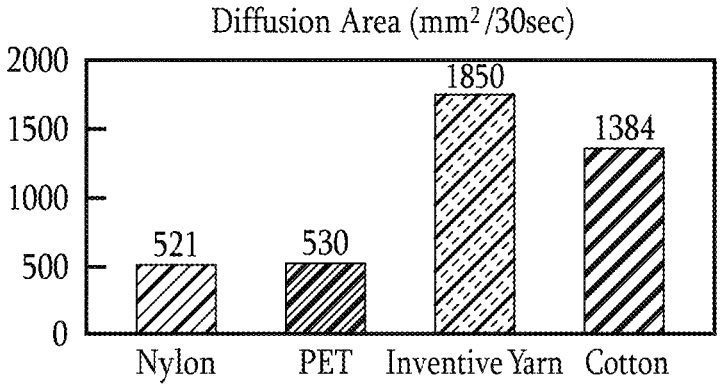
FIG. 4 is a bar graph depicting the Water Droplet Diffusion Areas of various tested fabrics produced from nylon fibers, conventional polyethylene terephthalate (PET) fibers, cotton fibers, and the inventive polyester filaments.

In addition, the water droplet diffusion area of the fabrics was also tested in order to further analyze the moisture wicking capabilities of the inventive polyester yarns. For this test, the fabric samples were flattened and suspended in the air. Next, 0.2 mL of water was dropped onto the sample and the diffusion area of the water on the fabric was measured with a ruler after 30 seconds. As shown in FIG. 4, the fabric produced from the inventive polyester yarns outperformed fabrics produced from conventional nylon, PET, and cotton yarns.

As can be seen in FIGS. 3 and 4, fabrics produced from the inventive polyester yarns exhibited better moisture absorption and wetting effects compared to fabrics produced from conventional nylon, PET, and cotton yarns. Consequently, this would result in a fabric that would be more comfortable to the wearer.

Definitions

It should be understood that the following is not intended to be an exclusive list of defined terms. Other definitions may be provided in the foregoing description, such as, for example, when accompanying the use of a defined term in context.

As used herein, the terms "a," "an," and "the" mean one or more.

As used herein, the term "and/or," when used in a list of two or more items, means that any one of the listed items can be employed by itself or any combination of two or more of the listed items can be employed. For example, if a composition is described as containing components A, B, and/or C, the composition can contain A alone; B alone; C alone; A and B in combination; A and C in combination, B and C in combination; or A, B, and C in combination.

As used herein, the terms "comprising," "comprises," and "comprise" are open-ended transition terms used to transition from a subject recited before the term to one or more elements recited after the term, where the element or elements listed after the transition term are not necessarily the only elements that make up the subject.

As used herein, the terms "having," "has," and "have" have the same open-ended meaning as "comprising," "comprises," and "comprise" provided above.

As used herein, the terms "including," "include," and "included" have the same open-ended meaning as "comprising," "comprises," and "comprise" provided above.

As used herein, "about" means that the recited value can deviate by 10 percent from the recited value. For instance, "about 1" would cover a range of 0.9 to 1.1.

Numerical Ranges

The present description uses numerical ranges to quantify certain parameters relating to the invention. It should be understood that when numerical ranges are provided, such ranges are to be construed as providing literal support for claim limitations that only recite the lower value of the range as well as claim limitations that only recite the upper value of the range. For example, a disclosed numerical range of 10 to 100 provides literal support for a claim reciting "greater than 10" (with no upper bounds) and a claim reciting "less than 100" (with no lower bounds).

CLAIMS NOT LIMITED TO DISCLOSED EMBODIMENTS

The preferred forms of the invention described above are to be used as illustration only, and should not be used in a limiting sense to interpret the scope of the present invention. Modifications to the exemplary embodiments, set forth above, could be readily made by those skilled in the art without departing from the spirit of the present invention.

The inventors hereby state their intent to rely on the Doctrine of Equivalents to determine and assess the reasonably fair scope of the present invention as it pertains to any apparatus not materially departing from but outside the literal scope of the invention as set forth in the following claims.

What is claimed is:

1. A process for the production of a headwear article, wherein the process comprises:

(a) applying a wax onto a yarn to form a treated yarn, wherein the wax comprises a paraffin wax, a silicone oil, a white oil, and a rapeseed oil, wherein the yarn comprises at least one polyester filament;

(b) twisting the treated yarn with at least one additional yarn to form a twisted yarn;

(c) knitting the twisted yarn with a jacquard machine to thereby form a knitted article;

(d) sewing the knitted article into a headwear body; and (e) finishing the headwear body to form the headwear article, wherein the finishing comprises ironing at least a portion of the headwear body, wherein the wax comprises (i) 25 to 95 weight percent of the paraffin wax, (ii) 1 to 50 weight percent of the silicone oil, (iii) 0.5 to 50 weight percent of the white oil, and (iv) 0.1 to 25 weight percent of the rapeseed oil.

2. The process of claim 1, wherein the polyester filament comprises a plurality of lobes.

3. The process of claim 2, wherein the polyester filament comprises a transverse aspect ratio of at least 1.5:1.

4. The process of claim 1, wherein the knitted article exhibits a vertical wicking height of at least 100 mm/10 minutes and a diffusion area of at least 1,700 $mm^2$/30 seconds.

5. The process of claim 1, wherein the yarn has an average denier in the range of 25 to 100 denier.

6. The process of claim 1, wherein the twisting of step (b) comprises twisting the treated yarn with 2 to 4 additional yarns.

7. The process of claim 1, wherein the wax comprises:

(i) 50 to 95 weight percent of the paraffin wax, (ii) 2 to 10 weight percent of the silicone oil, (iii) 1 to 10 weight percent of the white oil, and (iv) 0.5 to 10 weight percent of the rapeseed oil.

8. The process of claim 1, wherein the headwear article comprises a cap.

9. A process for the production of a headwear article, wherein the process comprises:

(a) applying a wax onto a yarn to form a treated yarn, wherein the yarn comprises at least two polyester filaments, wherein the wax comprises:

(i) a paraffin wax, a silicone oil, a white oil, and a rapeseed oil, (ii) a weight ratio of the paraffin wax to the silicone oil, the white oil, and/or the rapeseed oil of at least 2:1, (iii) a weight ratio of the silicone oil to the white oil or the rapeseed oil of at least 1:1, and (iv) a weight ratio of the white oil to the rapeseed oil of at least 1:1;

(b) twisting the treated yarn with at least one additional yarn to form a twisted yarn;

(c) knitting the twisted yarn to thereby form a knitted article;

(d) sewing the knitted article into a headwear body; and (e) finishing the headwear body to form the headwear article, wherein the finishing comprises ironing at least a portion of the headwear body.

10. The process of claim 9, wherein the polyester filaments comprise a plurality of lobes.

11. The process of claim 10, wherein the polyester filaments comprise a transverse aspect ratio of at least 1.5:1.

12. The process of claim 9, wherein the knitted article exhibits a vertical wicking height of at least 100 mm/10 minutes and a diffusion area of at least 1,700 $mm^2$/30 seconds.

13. The process of claim 9, wherein the yarn has an average denier in the range of 25 to 100 denier.

14. The process of claim 9, wherein the twisting of step (b) comprises twisting the treated yarn with 2 to 4 additional yarns.

15. The process of claim 9, wherein the wax comprises:
(i) 25 to 95 weight percent of the paraffin wax,
(ii) 1 to 50 weight percent of the silicone oil,
(iii) 0.5 to 50 weight percent of the white oil, and
(iv) 0.1 to 25 weight percent of the rapeseed oil.

16. The process of claim 9, wherein the wax comprises:
(i) 50 to 95 weight percent of the paraffin wax,
(ii) 2 to 10 weight percent of the silicone oil,
(iii) 1 to 10 weight percent of the white oil, and
(iv) 0.5 to 10 weight percent of the rapeseed oil.

* * * * *